US005099623A

United States Patent [19]

Smith et al.

[11] Patent Number: 5,099,623

[45] Date of Patent: Mar. 31, 1992

[54] PREFABRICATED WALL INSERT AND METHOD OF INSTALLATION

[76] Inventors: Donald D. Smith, 11422 Hesperian Cir., Gold River, Calif. 95670; Randell J. Wishart, 4957 Paloma Ave., Carmichael, Calif. 95608

[21] Appl. No.: 678,542

[22] Filed: Mar. 28, 1991

[51] Int. Cl.[5] ..... E04B 7/16

[52] U.S. Cl. ..... 52/201; 52/745; 52/73

[58] Field of Search ..... 52/201, 73, 745

[56] References Cited

U.S. PATENT DOCUMENTS

| | | | |
|---|---|---|---|
| 2,074,872 | 3/1937 | Thorin | 52/201 |
| 2,308,169 | 1/1943 | Grau | 52/73 |
| 2,834,441 | 5/1958 | Mims | 52/573 |
| 2,893,075 | 7/1959 | Potchen et al. | 52/66 |
| 3,487,597 | 1/1970 | Gutt | 52/73 |
| 3,782,063 | 1/1974 | Batorwicz et al. | 52/63 |
| 4,219,978 | 9/1980 | Brown | 52/274 |
| 4,236,361 | 12/1980 | Boden | 52/204 |
| 4,269,006 | 5/1981 | Larrow | 52/79.1 |
| 4,301,632 | 11/1981 | Wagner | 52/211 |
| 4,335,547 | 1/1982 | Maxwell et al. | 47/17 |
| 4,439,963 | 4/1984 | Feiss | 52/284 |
| 4,869,036 | 9/1989 | Peacock | 52/233 |
| 4,922,666 | 5/1990 | Rotter et al. | 52/66 |
| 4,947,615 | 8/1990 | Peacock | 52/745 |

*Primary Examiner*—Ridgill, Jr. James L.
*Attorney, Agent, or Firm*—James M. Ritchey

[57] ABSTRACT

A prefabricated wall insert unit is disclosed for rapid installation in a wall having an outer surface, an internal space, a ceiling plate, and a floor support. When installed, an exterior assembly, with upper and side perimeter attachment areas, projects away from the outer wall surface. A header is fastened to the exterior assembly proximate the upper perimeter attachment area and is within the wall internal space immediately below the ceiling plate. At least two side support members are fastened to the upper support member and to the exterior assembly proximate the side perimeter attachment areas. When installed in the wall, the header and each said side support member are within the wall internal space and each side support member extends from the header to proximate the wall floor support.

16 Claims, 6 Drawing Sheets

PREFABRICATED WALL INSERT AND METHOD OF INSTALLATION

BACKGROUND OF THE INVENTION

1. Field of the Invention

A prefabricated wall insert having an integral header and vertical ceiling plate-to-floor support members is disclosed for rapid installation into a selected wall of a building. A predetermined section of an existing wall is removed to generate a receiving aperture that mates with the insert to produce a modified wall that requires a minimum of surface refinishing to complete the installation.

2. Description of the Background Art

Building wall insert units, for installation into a pre-existing wall, have required that either the insert unit be prefabricated and small enough (garden windows and the like) to be placed into the wall without expansive wall modification (introduction of upper supports or headers) or constructed at the building location site (bay windows, large fireplaces and the like) and placed in the wall with extensive wall alterations (placement of upper supports or headers). Therefore, wall modifications or renovations have been limited to relatively small insert units with limited functionality or with the larger inserts to a process that is costly and very time intensive. The subject apparatus and method of installation overcome past limitations by supplying a relatively large and structurally sound prefabricated insert unit that is precisely and rapidly installed into any wall area without extensive on site wall structural modifications and finishing repairs.

Specific prior references include U.S. Pat. No. 2,893,075 that discloses a method of erecting enclosures that include door and window openings. Laminated panels of low density resin are assembled into a desired building form and door and window openings are cut into the resin. The cut edges of the resin are sealed and U-shaped channel sections are employed to line the door and window openings. The procedure relies upon the rigidity of the resin panels.

U.S. Pat. No. 3,487,597 relates an integral precast lintel balcony. This unit is designed to be inserted into a building as it is being constructed.

An expandable prefabricated building system and method of construction are presented in U.S. Pat. No. 3,782,063. Included is a preassembled rigid core unit with auxiliary floor sections and attached self-erecting or inflatable flexible membrane forms for satellite rooms surrounding the core unit.

Described in U.S. Pat. No. 4,219,978 is a precast reinforced concrete building panel wall structure. Each pre-cast panel has any required window openings or door openings, plumbing and electrical outlets, mounting brackets with self aligning grooves, and a sealed bottom edge. Bridging members extend along the top edge of the panels.

U.S. Pat. No. 4,236,361 discloses prefabricated building components made at a factory and assembled on site. The entire building is constructed from components comprising concrete reinforced steel columns attached to lightweight insulation molded over wire mesh running between the columns.

U.S. Pat. No. 4,269,006 explains a house assembly with prefabricated elements. No retrofitting of a conventional building is proposed in this disclosure. Insulation containing panels having outer perimeter grooves fit with support members to generate the house. Panels with a window or door opening fit into the assembly as would a solid panel.

A prefabricated module and method for making archways through building internal walls is presented in U.S. Pat. No. 4,301,632. The module fits below the ceiling top-plate, between existing vertical support studs within a building's internal wall. The lower support edges of the module rest on the floor bottom-plate. The upper curve of the arch is braced with a horizontal member and a plurality of angled components. The horizontal member is placed below ("recessed-depth below") the top edge of the module wall panels and substantially lower than the building's top-plate.

U.S. Pat. Nos. 4,869,036 and 4,947,615 disclose a modular building construction. A module is composed of a frame having two uprights for connection to opposed faces of adjacent columns and a panel connected to the uprights. The entire building is made from such unit modules. For existing conventional buildings, no retrofit options are presented.

A room addition is delineated in U.S. Pat. No. 4,922,666. The addition is a porch construction having recessed windows. The porch is attached to the outer surface of one existing house wall and a connection opening or door created in the existing wall.

SUMMARY OF THE INVENTION

An object of the present invention is to create a structurally stable prefabricated wall insert unit that is easily and quickly mounted into a wall opening, wherein the wall opening is cut to a predetermined size to eliminate unnecessary reconstruction around the cut opening to finalize the insertion.

A further object of the present invention is to present a prefabricated wall insert unit containing a header and side supports that permits the insertion of a desired structure such as a bay window, fireplace, closet, balcony, and the like into an exterior wall of an existing building.

An additional object of the present invention is to relate a method of efficiently and quickly installing a prefabricated wall insert unit so as to minimize the need for finishing repairs to the original wall.

Still another object of the present invention is to produce a method of installing a prefabricated wall insert unit into a wall of a building, by use of lifting means secured to the insert unit, in a period of time significantly shorter than the time required to construct an insert at the building's location and install the insert and with a minimum of installation personnel.

Disclosed is a prefabricated wall insert unit for installation in a wall of a building. Generally, the wall has an outer surface, an internal space, a ceiling plate, and a floor support. The subject apparatus comprises an exterior assembly having upper and side perimeter attachment areas. When the insert unit is installed in the wall, the assembly projects away from the outer wall surface. An elongated upper support member or header has two opposing ends and first, second, and third faces. The header is fastened by its first face to the exterior assembly proximate the upper perimeter attachment area. When the insert unit is installed in the wall the upper support member is within the wall internal space with the second face proximate the ceiling plate. A plurality of side support members, usually two on each side, are fastened to the upper support member third face and to the exterior assembly proximate the side perimeter attachment area. When the insert unit is installed in the wall each side support member is within the wall internal space and extends from the upper support member to proximate the wall floor support. To aid in installing the insert unit within the wall, a pair of mechanical come-alongs or winches, each with an associated cable, are connected to the insert unit with each cable running to an anchoring point in the wall. After an installer prepares an exact aperture in the wall, the installer employs the come-alongs to position and hold the insert unit until permanent fasteners are affixed.

Other objects, advantages, and novel features of the present invention will become apparent from the detailed description that follows, when considered in conjunction with the associated drawings.

DESCRIPTION OF THE PREFERRED EMBODIMENT

Referring now to FIGS. 1–7, there is shown a preferred embodiment of a prefabricated wall insert unit and method of installing the insert unit in a wall, usually an existing or under construction exterior wall, of a building. However, an interior wall of a building is a possible site for installing the subject insert. In particular, FIGS. 1–4 illustrate a preferred embodiment of the subject apparatus; that being a windowed alcove or bay window insert 10. Although all the figures specifically detail the structure of a windowed alcove insert 10, other insert units such as a doorway, picture window, fireplace, closet, balcony, bookshelf, sun space, home entertainment center, and the like are contemplated as being within the realm of this disclosure. Such additional insert versions rely on the novel and unobvious construction and installation techniques described below for the exemplary window insert 10 case.

The subject apparatus is to be installed in a standard wall having an outer surface, an internal space, a ceiling plate, and a floor support. Usually the inner and outer wall surfaces are constructed from lath and plaster, wallboard, and like materials that are easily cut and removed for installation of the subject device (see below for exact installation details). Near the ceiling, most walls have a ceiling plate that runs the general length of the wall. The ceiling plate is often one or more timbers or metal beams that give structural support for the building. In a traditional building employing wood support members the ceiling plate is one or two two-by-fours (see C in FIG. 2 for one such ceiling plate). At the bottom of the wall is a general floor support which is either the actual floor material (wood, cement, and the like) or in particular a bottom or floor plate, similar to the ceiling plate, is fastened to the floor (see F in FIG. 2 for one such floor plate). Within and between the two wall surfaces is an interior wall space having standard structural support elements such as vertical two-by-fours or other equivalent metal or wood supports. Horizontal members may also be present within the internal wall space for structural support and fire limitation. Further, insulation, electrical, and plumbing components may be within the internal wall space and would need to be removed or relocated during the installation of the subject insert. Other wall configurations may be employed for accepting the subject apparatus wall insert 10 by altering the disclosed structures and techniques by standard approaches.

Figure 1:
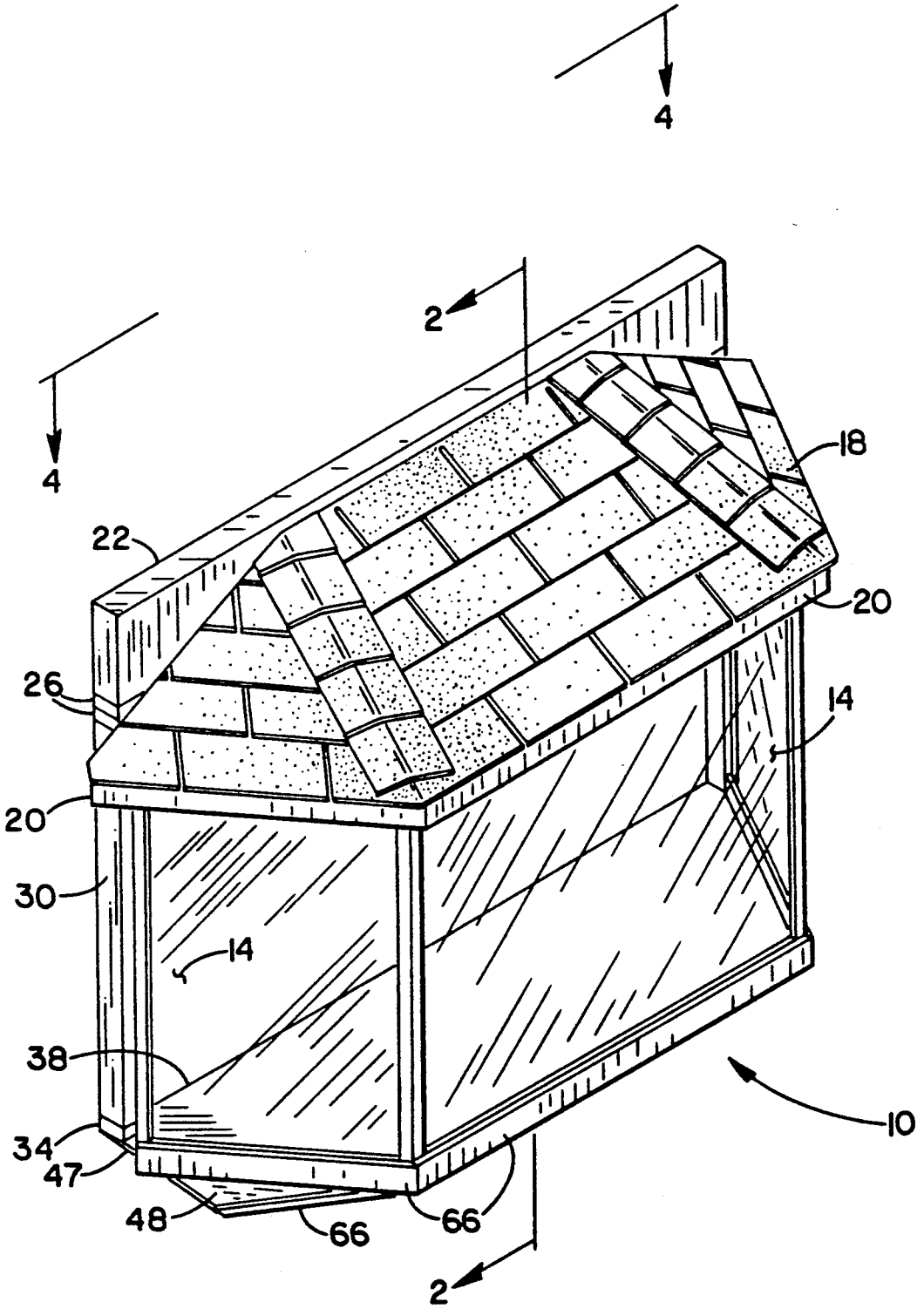
FIG. 1 is a perspective view of the subject apparatus as a bay window embodiment.

As mentioned, for clarity of the novel and unobvious structure and method of installation, an insert unit that is a windowed alcove 10 is depicted in the figures. FIG. 1 shows a typical complete prefabricated insert unit 10. Comprising the subject apparatus is an exterior assembly and an interior wall space assembly. When the insert unit is installed within a wall, the exterior assembly projects away from the outer wall surface. The exterior assembly has a perimeter border that extends around the connection between the exterior and interior assemblies. Proximate the perimeter border are at least upper and side perimeter attachment areas and usually a bottom attachment area for securing the exterior assembly to the interior wall space assembly. Attachment is generally by nailing, screwing, or bolting, with appropriate glues and insulation materials applied, but other equivalent methods are acceptable.

In particular, the exterior assembly, for the windowed alcove 10 example, has a window module 14 comprising one or more frames with each frame having top and bottom borders and at least one transparent pane held within each frame. For suitable insulation and light transmission properties, any configuration of the frame with filters, insulation, and the like are acceptable within the window module 14. Additionally, the number and exact geometric configuration of the frames may be any desired value or shape. By way of example and not limitation, a typical window module 14 may produce a generally rectangular alcove, a semicircular alcove, and the like. Specifically, FIG. 1 indicates the window module 14 generates an interior space that is approximately rectangular or perhaps trapezoidal in cross-sectional dimensions. The frames or window module 14 is fabricated from any desired material such as wood, metal, plastic, and the like and is finished usually to complement the building's design.

Associated with the window module 14 is a roof 18 attached proximate the frame top border. The covering material of the roof 18 is any desired substance such as shakes, tiles, shingles, and the like and is generally selected to match the roof covering of the parent building. Standard techniques are employed to mate the roof 18 with the window module to produce a satisfactory seal between the two.

Figure 2:
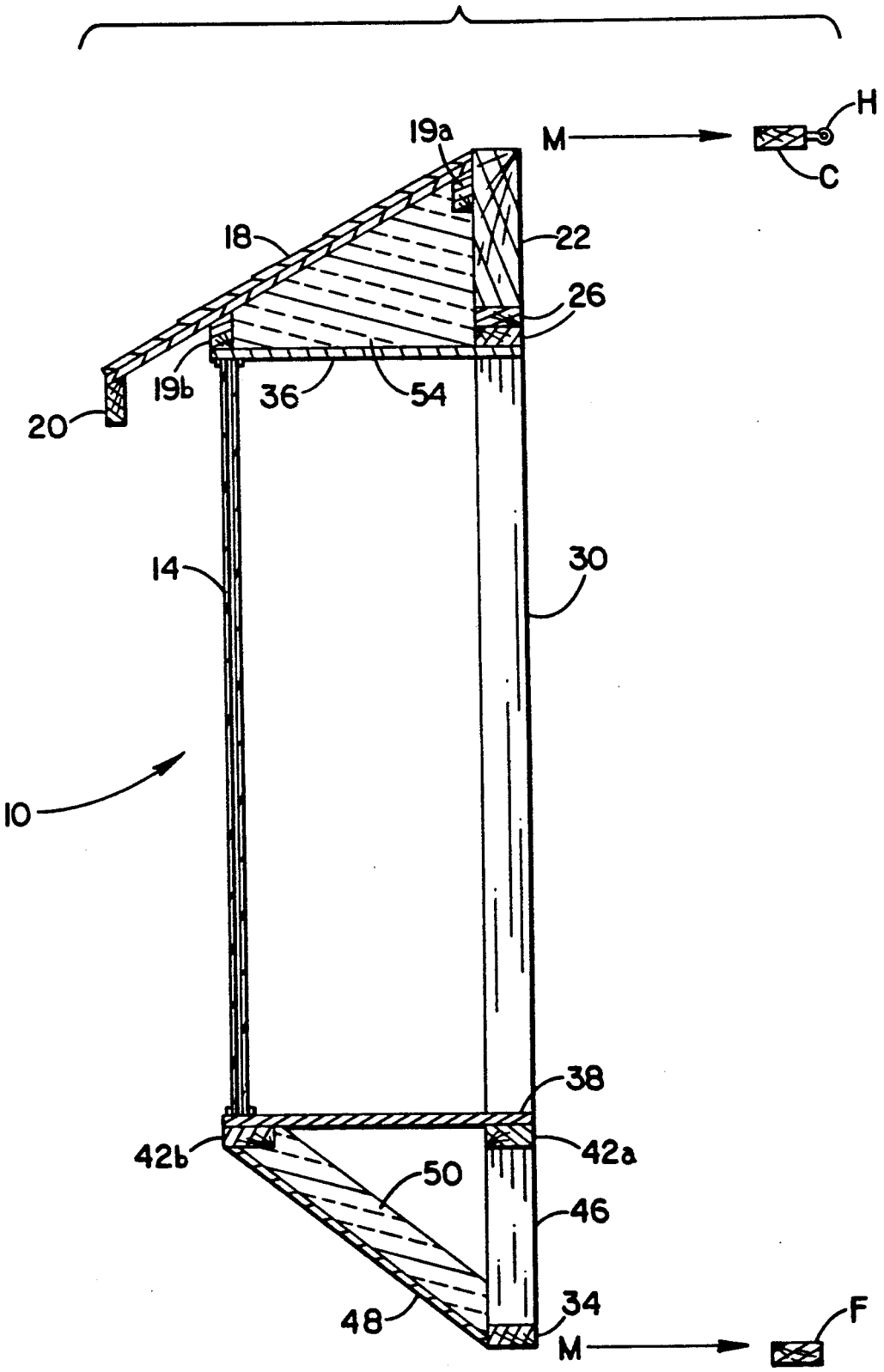
FIG. 2 is a cross-sectional view (along line 2—2 of FIG. 1) of the subject apparatus as a bay window embodiment.

As shown in FIG. 2, the roof 18 preferably has a proximal roof ledger 19*a* and a distal roof ledger 19*b*. The distal roof ledger 19*b* is used in securing the roof 18 to the window module 14. Also, the roof 18 is usually provide with a roof facia 20 for decorative and weather protection purposes. Roof ledger 19*a* is used to secure the roof 18 to an elongated upper support member or header 22 of the internal wall space assembly.

The roof 18 provides support for the unit's weight. Additionally, included as integral components of the roof 18 are structural supports beneath the exterior covering material. These roof 18 supports are not traditional rafters, but rather trusses for transferring most of the window module's 14 weight within the roof 18 directly to the header 22. By having most of the module's 14 weight transferred directly to the header 22 few or no unsightly vertical supports need to be placed within the window area. As long as the window module's weight is transferred to the header 22, various suitable configurations for the roof structural support trusses, or equivalent means, are contemplated by this disclosure. A benefit of not having traditional rafters within the roof 18 of the module 14 is that the window module 14 fits directly under the rafter tails of the existing building's roof. In other words, the module 14 inserts neatly under the roof overhang of the existing home.

Figure 3:
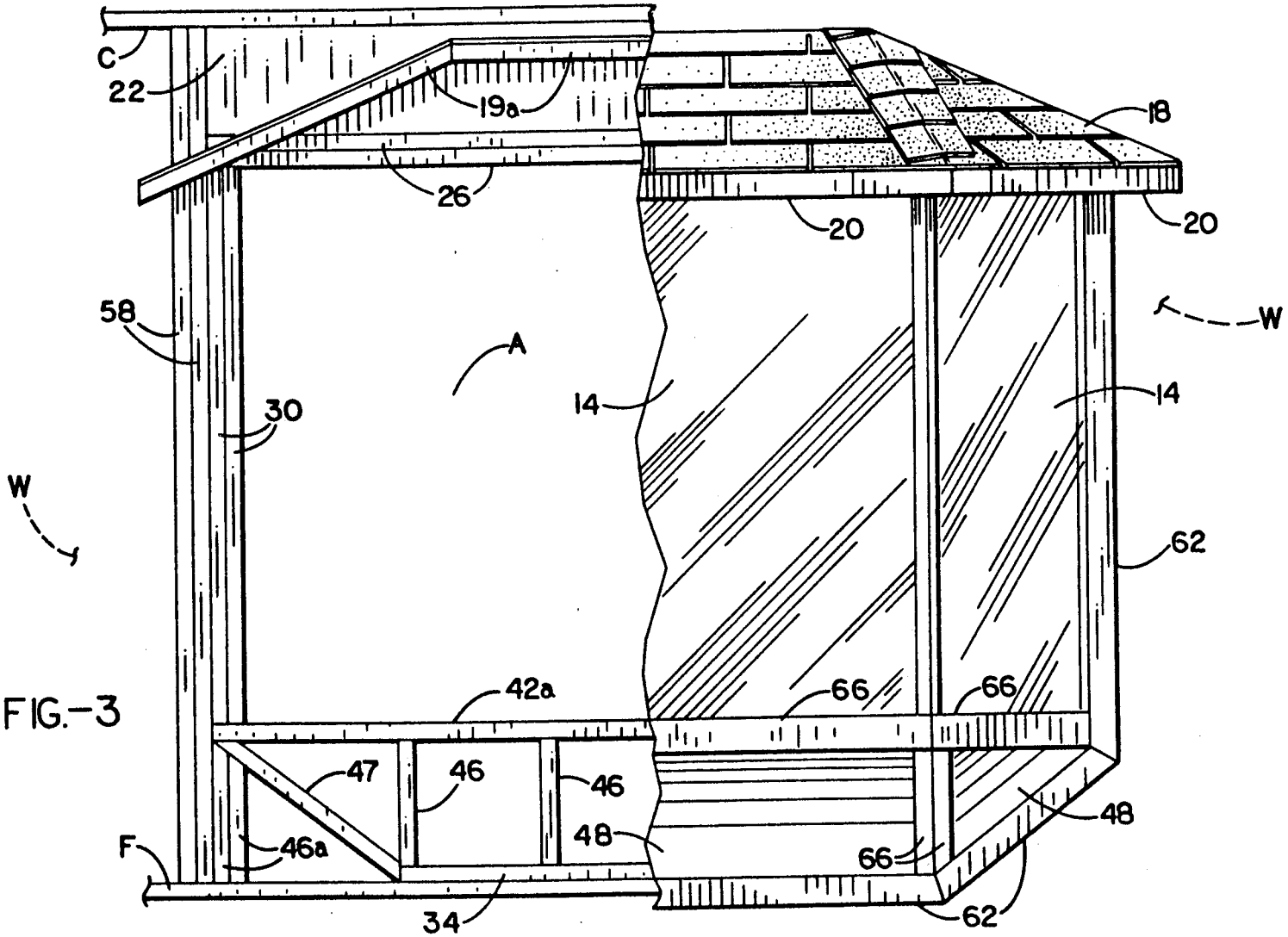
FIG. 3 is a half cut-away view (along line 3—3 of FIG. 4) of the subject apparatus as a bay window embodiment inserted or installed into a wall.
Figure 4:
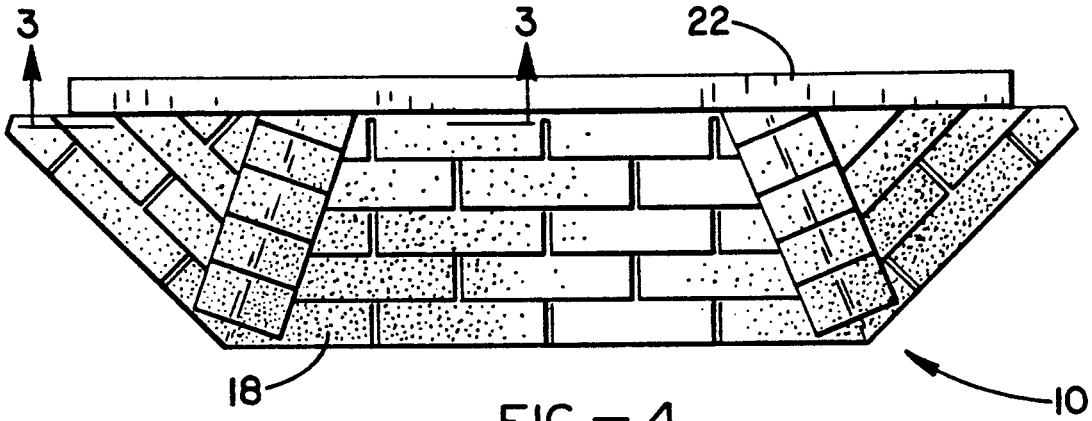
FIG. 4 is a top view (along line 4—4 of FIG. 1) of the subject apparatus as a bay window embodiment.

Normally, the internal wall space assembly has a pair of opposing side borders and a pair of opposing upper and lower borders. Further, to generate these side, upper, and lower borders, the internal wall space assembly comprises the upper support member 22 that has two opposing ends. Usually the upper support member 22 is traditionally termed a "header" and it supplies the structural integrity needed to support the building's ceiling when the wall is removed and the insert installed. A key element of the subject apparatus is the incorporation of this header 22 into the prefabricated insert. By including the header 22 in the insert the installers require a shorter time period to install the insert unit, due to less extensive wall modifications being required with the subject insert. Often, the upper support member 22 has, in addition to the opposing ends, at least first, second, and third faces and generally when rectangular in cross-section a fourth face. As seen in FIGS. 2 and 3, the roof 18 is preferably secured to the upper support member 22 via fastening to the proximal roof ledgers 19*a* strips that are usually nailed to a wooden header 22. When the upper support member 22 is positioned within the wall space, the upper support member 22 is proximate, usually immediately below and adjacent to, the ceiling plate C (see FIGS. 2 and 6 as indicated along the upper installation movement line M).

Below the upper support member 22 is at least one and usually two insert plate members 26 that extend the length of the upper support member 22. On each side of the interior wall space assembly is at least one (usually two on each side of the unit 10) side support member or side trimmer stud 30 that runs from proximate the upper support member 22 (usually immediately below the double insert plate members 26) to proximate the lower portion of the window module 14. As indicated, usually, there are two side trimmer studs 30 that are generally two by fours, as seen in FIG. 3. Preferably, spanning a portion of the bottom of the internal wall space assembly is a bottom insert plate 34. It should be noted that the floor support is either the actual building floor or a bottom plate F. The choice depends on if the bottom plate is to be removed to generate a flush entry of the exterior assembly bottom into the floor of the building, say in the case of the exterior assembly being a closet where a smooth transition of the floor is desirable to prevent accidental tripping over the connection area. One or more side support members 30 are placed under each upper support member 22 end. Each side support member 30 may be of any desired and suitable dimensions. Generally, the side support members 30 are located where the side borders of the window module are secured using standard means such as nailing, stapling, gluing, and the like.

Within the windowed alcove 10 is the interior space noted above. The interior space usually has a ceiling 36 located proximate the frame top and a bench 38 located proximate the frame bottom and secured by a bench plate or support 42, normally divided into a proximal 42*a* and a distal 42*b* bench plate.

Internal bottom support members or studs 46 and end bottom support members or bottom trimmer studs 46*a* are added to provide additional structural stability. With a window module 14, FIG. 3 indicates that the side support members 30 terminate proximate the bench support 42. An angled support 47 connects the lower end or ends or the side support members 30 to the lower insert plate 34. After the insert unit 10 is placed within the receiving wall opening A, the end bottom trimmer studs 46*a* are added, thereby supplying complete vertical support that runs from the floor through each trimmer stud 46*a*, the seat plate 42*a*, a side support 30, and to the header 22. Since the insert unit is positioned within the wall opening A without the end bottom trimmer studs 46*a*, the unit 10 easily slips into the receiving wall. In the depicted insert unit 10 where the external assembly extends horizontally in essentially equivalent dimensions with the internal wall space assembly (see FIG. 3 in particular), the internal bottom support members 46 are spread regularly across the lower area of the insert unit 10 spanning between the bottom insert plate 34, proximate the floor support, and the bench support 42. However, in some configurations of the subject exterior assembly (e.g., in cases where the exterior assembly side perimeter attachment areas are not parallel but angled or rounded towards the bottom) the side support members may be positioned in locations to accommodate standard structural necessities.

Specifically as shown in FIG. 2, an exterior assembly bottom wall 48 extends from proximate the window frames bottom borders to the interior wall space assembly proximate the bottom insert plate 34 (or the building's bottom plate F, when installed in a wall). To protect against the outside environment, a lower insulation area 50 is provided. Above the lower insulation area 50 and below the bench 38 is an optional storage area that may be accessed typically through a door in the bench 38. Lighting fixtures are optionally installed in the ceiling 36. As the local environment demands, roof insulation is added in an insert ceiling insulation chamber 54. This chamber 54 is either below the roof structural supports or the roof structural supports extend into the chamber 54.

Figure 6:
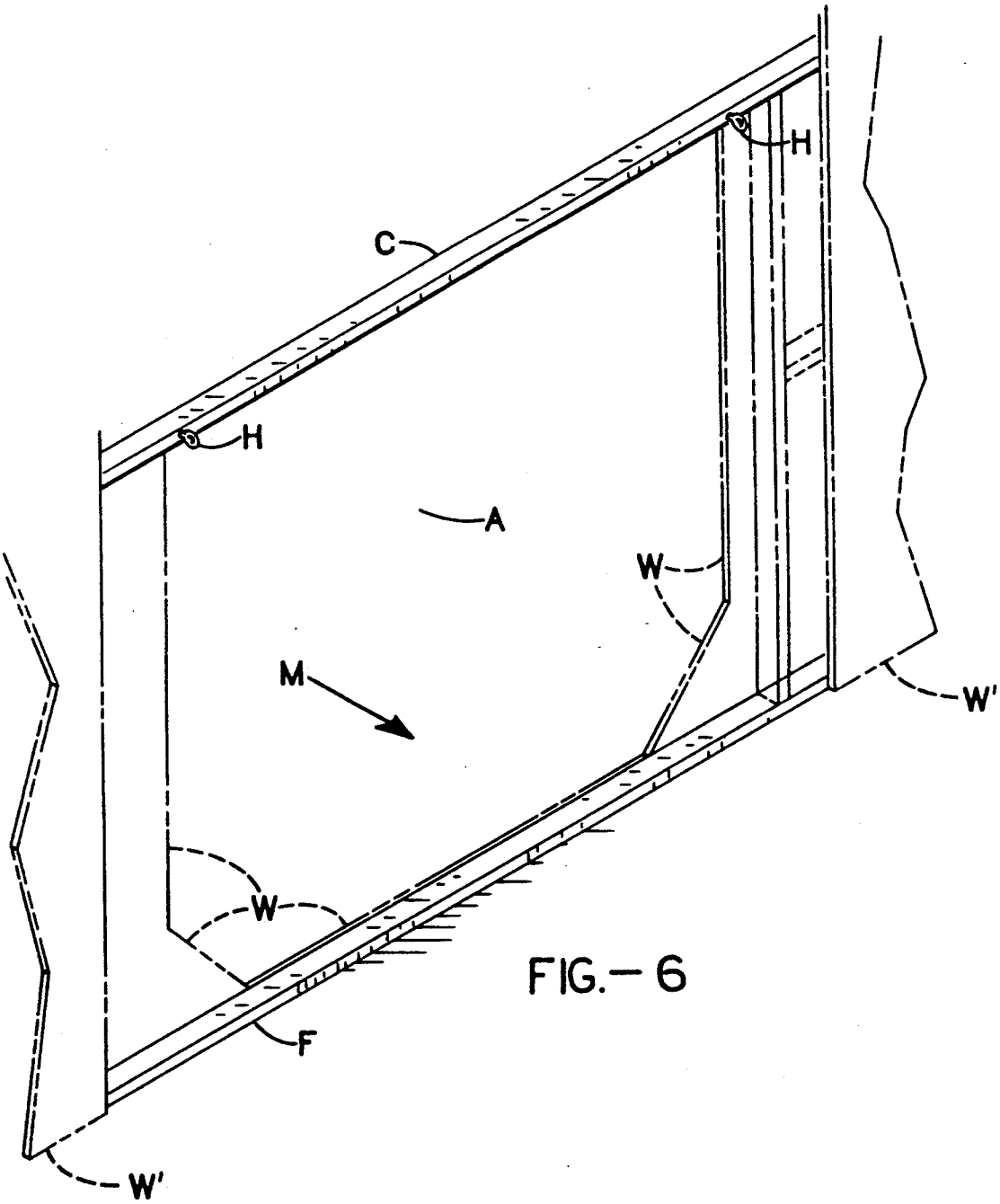
FIG. 6 is a front view of an inner wall surface that has been prepared for installation of the wall insert unit showing the inner wall surface and the insert unit receiving aperture exiting through the outer wall surface.

As illustrated in FIG. 3, when the prefabricated portion of the subject invention is installed, generally along movement line M, into a wall (for a complete view of the prepared wall with the outer surface W and the inner surface W', see FIG. 6), to anchor the insert unit, additional stabilizing vertical support components or "king studs" 58 are secured (either directly or indirectly) to ceiling plate C, the side support members 30, bottom trimmer studs 46*a*, and the bottom or floor plate F, Building regulations usually require that two such king studs 58 be placed on each side of the insert, however, fewer or greater king studs 58 may be used. Wood is usually employed for the studs, but equivalent material are acceptable.

To rapidly complete an installation of an insert unit within a wall, insert unit-to-wall facia strips 62 are provided that blend the unit with the outer wall W surfaces. Connecting, non-window surfaces of the window module 14 are usually finished with insert facia strips 66.

In general, the assembly of each insert unit utilizes a multi-station manufacturing and assembly line to speed construction time and to save on associated costs. All of the components are pre-cut to size. For speed and consistent assembly, pre-engineered jigs are employed in the unit's creation. Usually, each unit has national standard dimensions and fits within standard wall height dimensions of 92 and one-quarter inches.

Each insert unit 10 is pre-fabricated at a central manufacturing location before transportation to the installation site. Generally, the manufacturing process for a window insert comprises placing the header 22 in a top jig and attaching the roof 18, including support members and ledger 19*a*, to the header 22. Insert plate members 26 and side support members 30 are attached to the header 22. The bench 38, bottom wall 48, and associated supports (34, 42, 42*a*, 42*b*, 46, and 47) are placed in a bottom jig and attached to one another. Since the bottom wall 48 and associated supports transmit the load to the floor plate F of the existing wall, the lower portion of the unit does not require traditional footing or joist supports. Should the insert unit not be installed with a floor plate (to obtain a smooth transition from the unit to the house floor), straps, or like elements, are installed from the bottom of the unit to the header 22 for additional support. Pre-wiring and insulating to code are performed. Vapor barriers and siding are installed followed by placement of the desired windows. On the outside of the unit self-rimming trim is installed. Usually, wood pre-finished interior sheeting and trim is cut and provided but not installed until the unit is in place.

Figure 5:
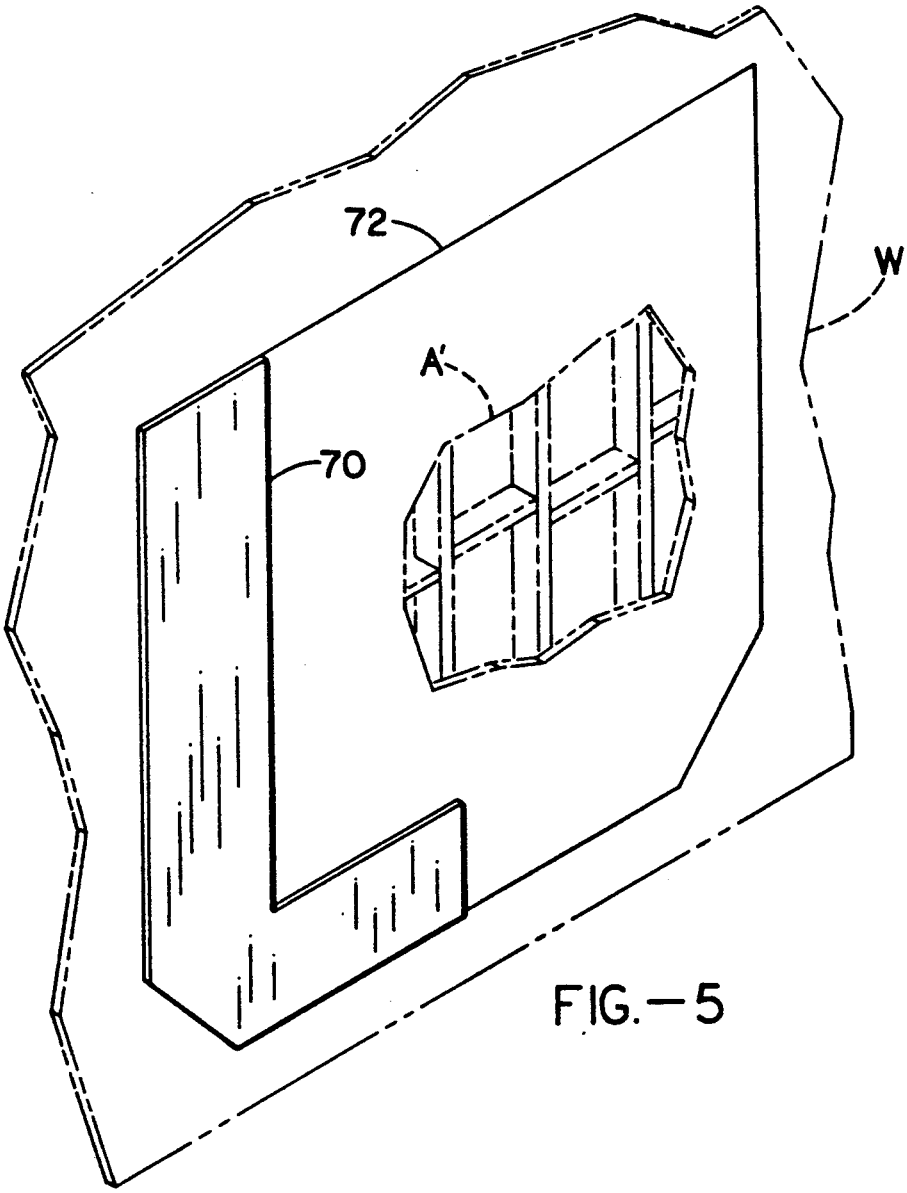
FIG. 5 is a perspective view of a building wall having a subject apparatus template placed on the wall surface with a worker creating a subject apparatus receiving opening in the wall within the area indicated by the template.
Figure 7:
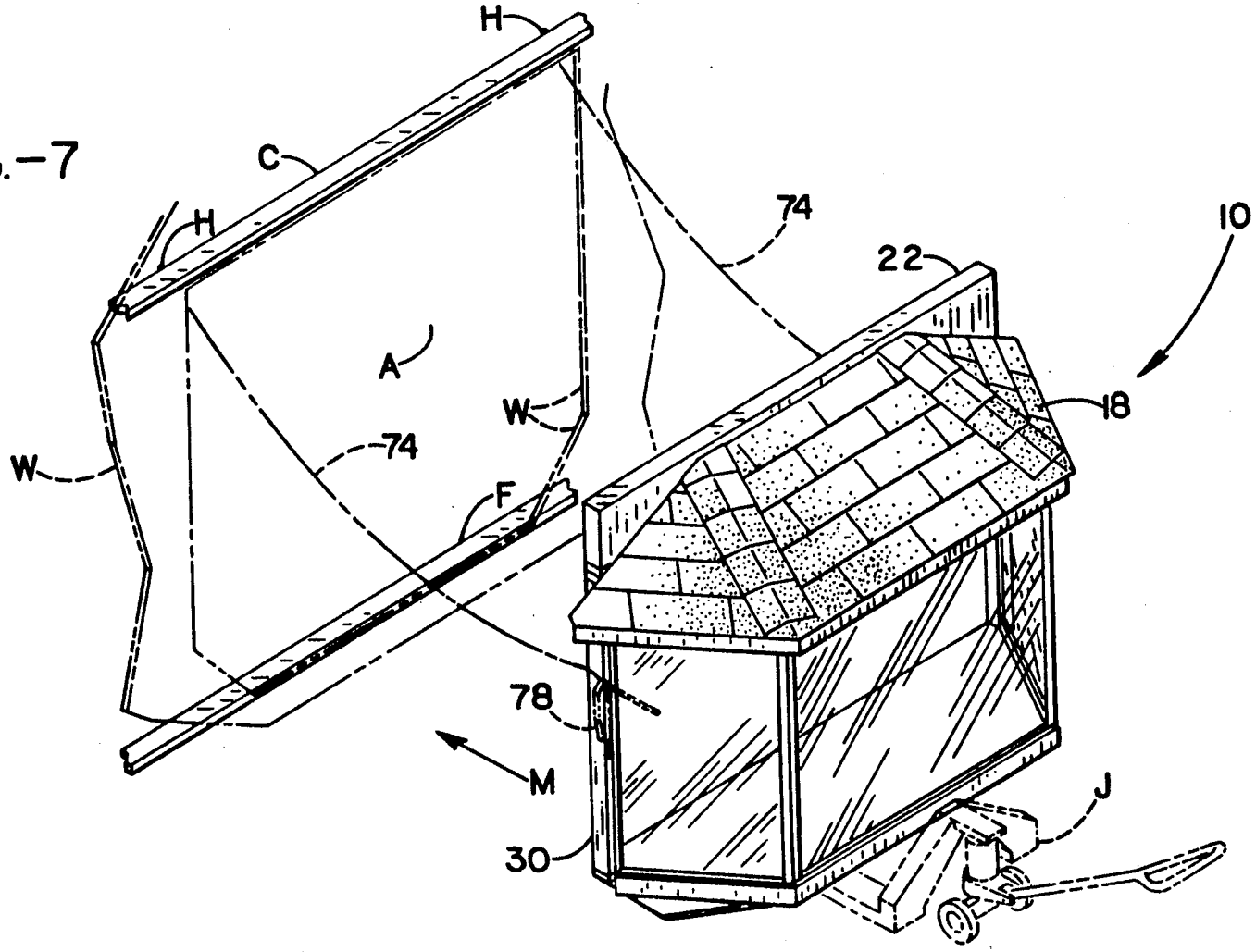
FIG. 7 is a perspective view of the subject apparatus being hoisted into position within the receiving wall opening by building-to-subject apparatus supporting and leveraging means.

FIGS. 5–7 indicate various steps in the installation process for the subject invention. A wall is selected and prepared by introducing a receiving aperture A in both the inner W′ and outer wall W surfaces such that the inner wall surface aperture spans vertically from the ceiling plate to proximate the floor support and horizontally a distance suitable for accepting the pair of opposing side borders. Additionally, the horizontal distance of the opening in the inner wall W′ needs to be sufficiently wide to permit working space for the installer to place at least one king stud 58 within the wall space proximate each side border (see FIG. 6).

In particular for a window insert unit, after locating the ceiling C and floor F plates, the installation process involves placing a centerline on the selected outer wall W surface. Next a generally vertical centerline is marked on the outer wall surface that extends between the ceiling and floor plates. The centerline denotes the midline between the insert unit's side borders. A temporary aperture template 70 is affixed to the outer wall surface. The template generally represents half of the exterior assembly profile and when flipped over on the wall W produces an outline of the exterior assembly's perimeter. The template 70 has a perimeter cutting guide edge to indicate and aid in marking the wall surface to be removed (line 72 indicates the cut to be made in the outer wall W surface). As indicated, the perimeter cutting guide edge is sized to generally outline the perimeter of the exterior assembly on the outer wall surface. Initially, a small portion of the outer wall surface W is removed and the process continued to generate the final opening A (see FIG. 5 for a view of the future opening A′ within the line 72 formed from the outline of the template 70).

Employing the template 70, the outer wall surface is cut along the line 72 generated by using the template perimeter cutting guide edge and the outer wall W surface removed within the template perimeter edge cut, thereby generating in the outer wall W surface a receiving aperture having a horizontal maximum dimension and a vertical maximum dimension that approximate the exterior assembly perimeter border. It should be noted that for the exemplary window module 14 the lower vertical portions of the outer wall W surface are angled inwardly to accept the bottom of the insert. By being angled inwardly the amount of additional repair to the outside wall W in minimized. Subsequently, the inner wall W′ surface is cut to produce a pair of vertical cuts spanning from the ceiling plate C to proximate said floor support. The pair of vertical cuts are positioned generally symmetrically about the centerline to generate in the inner wall W′ surface a larger insert unit receiving aperture than in the wall's outer surface W. The inner wall W′ aperture has a horizontal a distance between the pair of vertical cuts sufficiently larger than outside wall W surface insert unit receiving aperture's horizontal dimension to permit the installer enough working room within the wall's internal space to install at least one king stud 58 on each side of the unit within the wall internal space.

The inner wall W′ surface between the pair of vertical cuts and between the ceiling plate C and proximate the floor support is removed to produce the inner wall W′ insert unit receiving aperture. Next, the wall internal space structural support elements are remove, along with any insulation and plumbing and electrical elements, thereby generating a complete receiving aperture (see A in FIG. 3) piercing the selected wall from outer surface W to inner surface W′.

The wall insert unit is moved proximate the outer wall W insert unit receiving aperture and readied for hoisting into position. The insert unit is hoisted (usually the top portion first) through the outer wall W insert unit receiving aperture to position the interior wall space assembly within the wall's internal space. The exterior assembly projects away from the outer wall W. The interior wall space assembly upper and lower borders spans from the ceiling plate C to proximate the floor support or with the exemplary window unit the floor plate F. The upper support header 22 rests immediately below the ceiling plate C.

For positioning of the insert unit within the wall a lifting means is provided. Two such lifting means are shown in FIG. 7. First, secured to and between both the wall insert unit and the wall (secured by hooks H placed in or proximate to the ceiling plate C or by equivalent means) are cables 74. More specifically, the lifting means usually comprises a mechanical winch or come-along 78 having an integral extendable two ended uptake cable 74. Generally two winches 78 are employed, one secured proximate each side border or the insert unit. Each winch 78 is fastened to a cable end while the other cable end is secured to an anchor point H (screw, bolt, or the like) in the wall or ceiling plate C (see FIG. 7). The installer tightens the winches 78 to hoist the insert unit into position. Once in position, each winch 78 and associated cable 70 are removed. A second lifting means seen in FIG. 7 is a jack J that may be used to aid the winch 78 system or be employed in place of the winch 78 system. Usually the jack J has wheels to aid in positioning the unit. The installer moves the insert unit close to the outer wall W and then by means of the jack J elevates the unit into position.

The installer then anchors the upper border to the ceiling plate by nailing or a similar process. With a window module 14, additional end bottom support members or end trimmers studs 46*a* are installed. King studs 58 are inserted within the wall internal space proximate each interior wall space assembly side support 30 member and attached to the side support member 30, end trimmer studs 46*a*, ceiling plate C, and floor plate F.

To complete the installation, since the insert unit is a complete unit, a minimum of damage has been inflicted on the surrounding wall (W and W') surfaces. The inner W' and outer W walls are finished to blend with the insert unit. Since the insert unit is usually supplied with a self-rimming trim for finishing the outer wall-to-insert unit connection joint, the outer wall W surface is especially easy to finish. The inner trim, usually wood panels or strips, is applied to cover the extra inner wall surface that was removed to provide sufficient working room to install the king studs 58.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A prefabricated wall insert unit for installation in a wall of a building, wherein said wall has inner and outer surfaces, an internal space, a ceiling plate, and a floor support, comprising:

a) an exterior assembly wherein when said insert unit is installed in said wall said assembly projects away from said outer wall surface and b) an interior wall space assembly comprising:

an elongated upper support member having two opposing ends fastened to said exterior assembly wherein when said insert unit is installed in said wall said upper support member is within said wall internal space proximate said ceiling plate and a plurality of side support members having first and second ends with each said side support member fastened by said side support first end to proximate said upper support member and to said exterior assembly wherein each said side support member is within said wall internal space when said insert unit is installed in said wall.

2. A prefabricated wall insert unit according to claim 1, wherein said elongated upper support is a header.

3. A prefabricated wall insert unit according to claim 1, further comprising, when installed into said wall, a plurality of vertical support components spanning from proximate said ceiling plate to proximate said floor support wherein when said insert unit is installed in said wall each said vertical support component is within said wall internal space and each said vertical support component is fastened to either one of said upper support member ends and a said side support member or to another said vertical support component which is fastened to either one of said upper support member end and a said side support member.

4. A prefabricated wall insert unit according to claim 1, further comprising, when installed into said wall, a plurality of end bottom support members wherein each said end bottom support member extends between proximate each said side support member second end and proximate said floor support.

5. A prefabricated wall insert unit according to claim 1, wherein said exterior assembly is a windowed alcove, comprising:

a) a window module having a frame with top and bottom borders and a transparent pane held within said frame and b) a roof structure attached proximate said frame top border wherein said roof structure is secured to said upper support member.

6. A prefabricated wall insert unit according to claim 5, further comprising within said window module an interior space having a ceiling located proximate said frame top and a bench located proximate said frame bottom.

7. A prefabricated wall insert unit for installation in an exterior wall of a building, wherein said wall has inner and outer surfaces, an internal space, a ceiling plate, and a floor support, comprising:

a) an exterior assembly having upper and side perimeter attachment areas wherein when said insert unit is installed in said wall said assembly projects away from said outer wall surface;

b) an interior wall space assembly comprising:

a header having two opposing ends and first, second, and third faces fastened by said first face to said exterior assembly proximate said upper perimeter attachment area wherein when said insert unit is installed in said wall said header is within said wall internal space with said second face secured to said ceiling plate and a plurality of side support members having first and second ends with each said side support member fastened by said side support member first end to proximate said header third face and to said exterior assembly proximate said side perimeter attachment area wherein each said side support member is within said wall internal space when said insert unit is installed in said wall; and c) a plurality of vertical support components spanning from proximate said ceiling plate to proximate said floor support wherein when said interior wall space assembly is installed in said wall each said vertical support component is within said wall internal space and each said vertical support component is fastened to one of said header ends and a said side support member or to another said vertical support component which is fastened to one of said header ends and a said side support member.

8. A prefabricated wall insert unit according to claim 7, wherein said exterior assembly is a windowed alcove, comprising:

a) a window module having a frame and a transparent pane held within said frame;

b) a roof structure attached above said frame wherein said roof structure is secured to said header; and c) an interior space, within said window module, having a ceiling located proximate said frame top and a bench located proximate said frame bottom.

9. A prefabricated wall insert unit according to claim 7, further comprising, when said unit is installed within said wall, a plurality of end bottom support members wherein each said end bottom support member extends between proximate each said side support member second end and proximate said floor support.

10. A method of installing a prefabricated wall insert unit in a wall of a building by an installer, wherein said wall has an outer surface an inner surface, an internal space having structural support elements, a ceiling plate, and a floor support, comprising the steps:

a) preparing said wall and said interior wall space for receiving said wall insert unit wherein said wall insert unit comprises:

an exterior assembly with a perimeter border wherein when said insert unit is installed in said wall said exterior assembly projects away from said outer wall surface and an interior wall space assembly having a pair of opposing side borders and a pair of opposing upper and lower borders by introducing a receiving aperture in both said inner and outer wall surfaces such that said outer wall aperture approximates said exterior assembly perimeter border and said inner wall aperture spans vertically from said ceiling plate to proximate said floor support and horizontally a distance suitable for accepting said pair of opposing side borders plus sufficient additional space for said installer to place at least one vertical support member within said wall space proximate each said side border when said interior wall space assembly is within said interior wall space;

b) removing from said internal wall space said structural support elements between said ceiling plate and said floor support;

c) installing, with the aid of lifting means, said insert unit into position within said wall internal space wherein said interior wall space assembly upper and lower borders spans from said ceiling plate to proximate said floor support;

d) inserting each said vertical support member within said wall internal space proximate a said interior wall space assembly side border; and e) attaching each said vertical support members to a said interior wall space assembly side border.

11. A method of installing a prefabricated wall insert unit in a wall of a building according to claim 10, further comprising the step of installing a plurality of end bottom support members within said wall wherein each said end bottom support member extends between proximate each said side support member second end and proximate said floor support.

12. A method of installing a prefabricated wall insert unit in a wall of a building according to claim 10, wherein said lifting means comprises a mechanical winch having an integral extendable two ended uptake cable wherein said winch, fastened to one said cable end, is secured to said wall insert unit with said cable running from said winch to an anchor point in said wall whereby said installer operates said winch to hoist said insert unit into position in said wall.

13. A method of installing a prefabricated wall insert unit in a wall of a building by an installer, wherein said wall has an outer surface an inner surface, an internal space having structural support elements, a ceiling plate, and a floor support, comprising the steps:

a) locating said ceiling and floor support within said wall;

b) establishing a generally vertical centerline on said outer wall surface that extends between said ceiling and floor plates for positioning the center of said insert unit wherein said wall insert unit comprises:

an exterior assembly with a perimeter border wherein when said insert unit is installed in said wall said exterior assembly projects away from said outer wall surface and an interior wall space assembly having a pair of opposing side borders and a pair of opposing upper and lower borders wherein said centerline generally parallels said opposing side borders and lies between said side borders when said wall insert is installed in said wall;

c) attaching a temporary aperture template having a perimeter cutting guide edge to said outer wall surface so that said template aligns with said centerline wherein said perimeter cutting guide edge is sized to generally outline said exterior assembly on said outer wall surface;

d) cutting said outer wall surface along said template perimeter cutting guide edge;

e) removing said outer wall surface within said template perimeter edge cut thereby generating in said outer wall surface a first insert unit receiving aperture having a horizontal dimension and a vertical dimension and said first aperture approximates said exterior assembly perimeter border;

f) cutting said inner wall surface to produce a pair of vertical cuts spanning from said ceiling plate to proximate said floor support wherein said pair of vertical cuts are positioned generally symmetrically about said centerline;

g) removing said inner wall surface between said pair of vertical cuts and between said ceiling plate and proximate said floor support to generate in said inner wall surface a second insert unit receiving aperture with a horizontal distance between the said pair of vertical cuts sufficiently larger than said first insert unit receiving aperture horizontal dimension to permit said installer enough working room within said wall internal space to install a vertical support component within said wall internal space and attach said vertical support component to each of said interior wall space assembly opposing side borders wherein each said vertical support component spans from said ceiling plate to proximate said floor support;

h) removing said wall internal space structural support elements;

i) positioning said wall insert unit proximate said first insert unit receiving aperture;

j) installing said insert unit through said first insert unit receiving aperture to position said interior wall space assembly within said wall internal space wherein said interior wall space assembly upper and lower borders spans from said ceiling plate to proximate said floor support;

k) anchoring said upper border to said ceiling plate;

l) inserting each said vertical support member within said wall internal space proximate a said interior wall space assembly side border;

m) attaching each said vertical support members to a said side border; and n) finishing said inner and outer wall surfaces to blend with said wall insert.

14. A method according to claim 13, wherein said upper insert border comprises a horizontal header spanning between said opposing side borders.

15. A method of installing a prefabricated wall insert unit in a wall of a building according to claim 13, wherein said positioning of said insert unit is by a lifting means.

16. A method of installing a prefabricated wall insert unit in a wall of a building according to claim 15, wherein said lifting means comprises a mechanical winch having an integral extendable two ended uptake cable wherein said winch, fastened to one said cable end, is secured to said wall insert unit with said cable running from said winch to an anchor point in said wall whereby said installer operates said winch to hoist said insert unit into position in said wall.

* * * * *